US009175611B2

(12) United States Patent
Pluta et al.

(10) Patent No.: US 9,175,611 B2
(45) Date of Patent: Nov. 3, 2015

(54) FLEXIBLE COUPLING/LINKAGE FOR AN ACTUATOR

(75) Inventors: Christopher J. Pluta, Ithaca, NY (US); Mark M. Wigsten, Lansing, NY (US); Michael W. Marsh, Dryden, NY (US)

(73) Assignee: BorgWarner, Inc., Auburn Hills, MI (US)

( * ) Notice: Subject to any disclaimer, the term of this patent is extended or adjusted under 35 U.S.C. 154(b) by 0 days.

(21) Appl. No.: 14/237,943

(22) PCT Filed: Aug. 23, 2012

(86) PCT No.: PCT/US2012/051991

§ 371 (c)(1),
(2), (4) Date: Feb. 10, 2014

(87) PCT Pub. No.: WO2013/032837

PCT Pub. Date: Mar. 7, 2013

(65) Prior Publication Data

US 2014/0202408 A1 Jul. 24, 2014

Related U.S. Application Data

(60) Provisional application No. 61/528,911, filed on Aug. 30, 2011.

(51) Int. Cl.

| | |
|---|---|
| ***F01L 1/18*** | (2006.01) |
| ***F02D 13/02*** | (2006.01) |
| ***F01L 13/00*** | (2006.01) |

(52) U.S. Cl.

CPC ..... *F02D 13/02* (2013.01); *F01L 1/181* (2013.01); *F01L 13/0021* (2013.01); *Y10T 29/49293* (2015.01)

(58) Field of Classification Search

CPC ..... F01L 1/181; F01L 13/0021
USPC ..... 123/90.39, 90.44
See application file for complete search history.

(56) References Cited

U.S. PATENT DOCUMENTS

| | | | |
|---|---|---|---|
| 4,494,495 | A | 1/1985 | Nakamura et al. |
| 4,503,818 | A | 3/1985 | Hara et al. |

(Continued)

FOREIGN PATENT DOCUMENTS

| | | | |
|---|---|---|---|
| EP | 0067311 | A1 | 12/1982 |
| KR | 100974763 | B1 | 8/2010 |

*Primary Examiner* — Ching Chang

(74) *Attorney, Agent, or Firm* — Helmholdt Law PLC; Thomas D. Helmholdt

(57) ABSTRACT

A flexible coupling linkage (14) anchors a housing (16) that at least partially encloses a rotor (18) of an actuator (22) against rotation, while allowing free movement of the housing (16) in two other planes relative to the rotor (18) to match an angular rotational plane orientation of the rotor (18) to prevent binding between the housing (16) and the rotor (18) due to misalignment. The flexible coupling linkage (14) can be selected from a group of pivot joints (24*a*, 24*b*) including at least one of a pivot pin joint (30, 34), a ball-and-socket joint (32), and any combination thereof. The pivot joint (24) defines a restrained point (26*a*, 26*b*) associated with the housing (16) radially spaced from an axis of rotation of the rotor (18) preventing rotation of the housing (16) about the axis of rotation of the rotor (18), while allowing angular displacement of the housing (16) about the restrained point (26*a*, 26*b*) permitting the housing (16) to match an angle of the rotor (18) to prevent binding between the housing (16) and the rotor (18).

15 Claims, 2 Drawing Sheets

(56) References Cited

U.S. PATENT DOCUMENTS

| | | | | |
|---|---|---|---|---|
| 4,770,060 | A | 9/1988 | Elrod et al. | |
| 4,771,772 | A | 9/1988 | DeWitt | |
| 5,417,186 | A | 5/1995 | Elrod et al. | |
| 6,257,186 | B1 | 7/2001 | Heer | |
| 6,491,008 | B1 | 12/2002 | Zubeck | |
| 7,942,123 | B2 * | 5/2011 | Hara et al. | 123/90.39 |
| 8,191,522 | B2 | 6/2012 | Riley | |
| 8,251,026 | B2 | 8/2012 | Lee | |

* cited by examiner

FLEXIBLE COUPLING/LINKAGE FOR AN ACTUATOR

FIELD OF THE INVENTION

The invention relates to rotational torque transmitted via a torsional drive mechanism for rotary shafts, and more particularly, to rotational torque transmitted via an actuator for changing an operating configuration of at least one rocker arm or lifter of an internal combustion engine of a motor vehicle.

BACKGROUND

Variable valve timing mechanisms for internal combustion engines are generally known in the art. For example, see U.S. Pat. No. 4,494,495; U.S. Pat. No. 4,770,060; U.S. Pat. No. 4,771,772; U.S. Pat. No. 5,417,186; and U.S. Pat. No. 6,257,186. Some variable valve lift and timing systems can offer continuous and variable intake valve lift and duration. The timing on intake and/or exhaust camshafts can be modified with various cam phaser configurations. A mechanism can be provided intermediate the crank-shaft and the poppet-type intake or exhaust valve of an internal combustion engine for operating at least one such valve. Variable intake valve lift and timing mechanisms typically require the addition of a rocker arm located between a cam and the valve actuated thereby which serves to modify the operational relationship of the one to the other. This provides a mechanism to vary the time, extent of duration, of valve opening relative to the operating cycle of the engine. The rocker arm can be pivoted about a rocker arm axis, which can be offset with respect to a rotational axis of a control shaft connected to an actuator. To obtain optimum values for fuel consumption and exhaust emissions under different operating conditions of an internal combustion engine, the valve lift and timing can be varied in dependence on different operating parameters.

A control shaft can be rotated through a predetermined angular arc using a mechanical device, such as an actuator, to vary the valve lift and timing. Mechanical actuators require precise tolerances and alignment to function properly. Misalignment between the control shaft and the actuator can create problems preventing proper function of the variable valve lift and timing duration mechanism. It would be desirable to provide an assembly capable of adapting to misalignment between the control shaft and an actuator. It would be desirable to provide an assembly capable of accommodating tolerance stack up and thereby resolving binding issues that adversely affect control shaft and actuator system assemblies.

SUMMARY

In a variable valve lift and timing assembly for an internal combustion engine of a motor vehicle, an actuator can be provided driving a control shaft of a rocker arm in rotation through at least a predetermined arc and can include a housing at least partially enclosing a rotor. A flexible coupling linkage restrains the housing against rotation while allowing free movement of the housing in two other planes relative to the rotor to match an angular rotational plane orientation of the rotor to prevent binding between the housing and the rotor due to misalignment.

In a method of assembling a variable valve lift and timing assembly for an internal combustion engine of a motor vehicle having an actuator for driving a control shaft of a rocker arm in rotation through at least a predetermined arc and can include a rotor at least partially enclosed by a housing. The housing is restrained against rotation with a flexible coupling linkage, allowing free movement of the housing in two other planes relative to the rotor to match an angular rotational plane orientation of the rotor to prevent binding between the housing and the rotor due to misalignment.

In a variable valve lift and timing assembly for changing operating characteristics of at least one poppet-type valve of an internal combustion engine of a motor vehicle, an actuator can be provided for driving a rotary control shaft of a rocker arm in rotation through at least a predetermined arc. The actuator can include a housing at least partially enclosing a rotor. A flexible coupling linkage restrains the housing against rotation with respect to an axis of rotation of the rotor, while allowing free movement of the housing in two other planes relative to the rotor to match an angular rotational plane orientation of the rotor to prevent binding between the housing and the rotor due to misalignment. The flexible coupling linkage is connected between the housing and a structural member, such as a structural portion of the internal combustion engine. The flexible coupling linkage can be selected from a group of joints including at least one of a pivot pin joint and a ball-and-socket joint and any combination thereof. The pivot pin joint and ball-and-socket joint define at least one restrained point associated with the housing radially spaced from an axis of rotation of the rotor preventing rotation of the housing about the axis of rotation of the rotor, while allowing angular displacement of the housing about the restrained point permitting the housing to match an angle of the rotor.

When mounting an actuator between two points (rotor to shaft and the housing to block or head of the engine) the perpendicularity and tolerance stack up between the parts becomes critical. If the mounting face for the housing and endplates are not on the same plane as the rotor, then the parts could bind. There are two ways to prevent binding. The first is to hold very tight tolerances. This requires a lot of finish machining or grinding and is very expensive. The second way to prevent binding is to use a flexible coupling linkage. The flexible coupling linkage allows the housing to pivot and float around the rotor to prevent binding between the two parts. The flexible coupling linkage restrains the housing from rotating or spinning with respect to an axis of rotation of the rotor, while at the same time the flexible coupling linkage allows the housing to move freely in the other two planes to match the angle of the rotor.

The flexible coupling linkage can include a bolt attached to the head or block of the engine holding the bottom of an anchor member against the surface that the anchor member is mounted to, thereby grounding the anchor member. A link arm can be placed perpendicular to the anchor member. The anchor member and link arm can be pinned or bolted together for pivotal movement relative to one another. The link arm can rotate about the bolted or pinned connection. A pivotal joint, such as a bolt or a pin can attach the other end of the link arm to the housing or endplates of the cam phaser through the center of the joint for pivotal movement of the housing and link arm relative to one another. Alternatively, the other end of link arm can include a ball-and-socket joint, where a ball can be pressed into a corresponding socket to connect the housing with respect to the flexible coupling linkage for pivotal movement with respect to one another. The flexible coupling linkage restrains the housing from rotating but, because of the pivotal joint or ball joint, the housing is able to align with the rotor so that no binding will occur.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
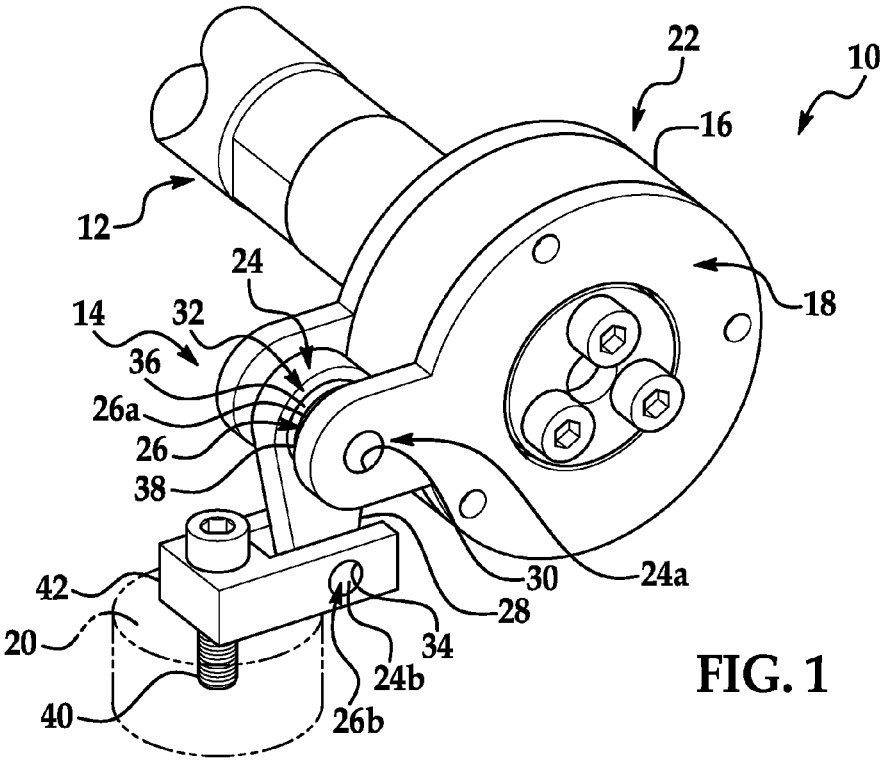
FIG. 1 is a perspective view of a control shaft actuator having a flexible coupling linkage connected to at least one end plate of a housing.

Referring now to FIGS. 1-4, a variable valve lift and timing assembly 10 for an internal combustion engine 20 of a motor vehicle can include an actuator 22 connected to a control shaft 12 of a rocker arm 42 for driving the control shaft 12 in rotation through at least a predetermined arc 44. The actuator 22 can include a housing 16 at least partially enclosing a rotor 18. A flexible coupling linkage 14 can restrain or anchor the housing 16 against rotation, while allowing free movement of the housing 16 in two other planes relative to the rotor 18 to match an angular rotational plane orientation of the rotor 18 to prevent binding between the housing 16 and the rotor 18 due to misalignment. The flexible coupling linkage 14 can be connected between the housing 16 and a structural member of the internal combustion engine 20 for restraining or holding the housing 16 rotationally stationary, while permitting the housing 16 to move freely in two other planes to match an angle of the rotor. The flexible coupling linkage 14 can include at least one pivot joint 24 defining a restrained point 26 associated with the housing 16 radially spaced from an axis of rotation of the rotor 18 restraining or preventing rotation of the housing 16 about the axis of rotation of the rotor 18, while allowing angular displacement of the housing 16 about the restrained point 26 permitting the housing 16 to match an angle of the rotor 18.

Figure 4:
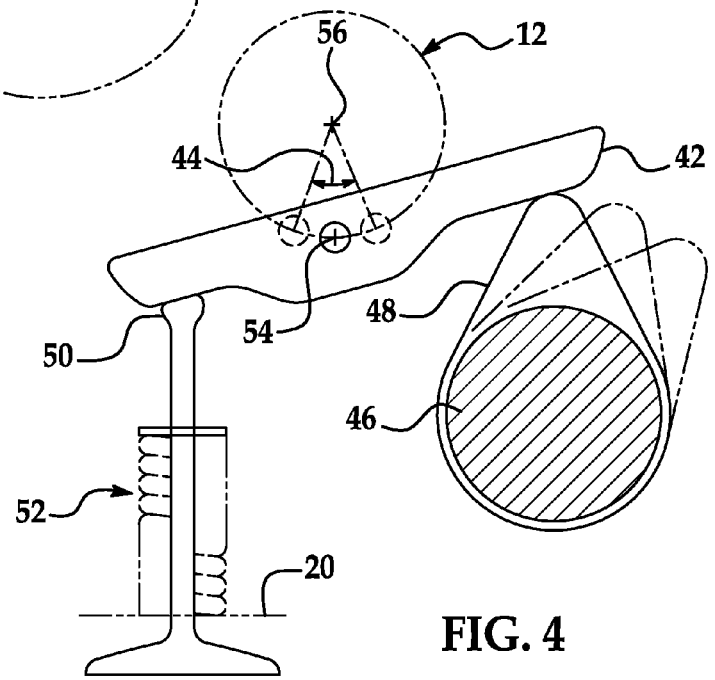
FIG. 4 is a simplified schematic view of a camshaft supporting a cam for engagement with a rocker arm for actuating a poppet-type valve of an internal combustion engine cylinder.

As best seen in the simplified schematic of FIG. 4, a camshaft 46 supports a cam 48 for operable engagement with rocker arm 42. A position of the rocker arm 42, through rotatable support of the control shaft 12, can be adjusted as shown in phantom through at least a predetermined arc 44. A poppet-type valve 50 of an internal combustion engine 20 can be operably engaged with the rocker arm 42 and is biased toward the rocker arm 42 by biasing spring 52. As the camshaft 46 rotates, the cam 48 is driven in rotation about the axis of the camshaft 46 and into operable engagement with the rocker arm 42. In response to engagement with the cam 48, the rocker arm 42 rotates about a pivot axis 54 supported offset from a pivot axis 56 of the control shaft 12. The rocker arm 42, being located between the cam 48 and the valve 50 actuated thereby, serves to modify the operational relationship of the one with respect to the other. Movement of the control shaft 12 through the predetermined arc 44 allows adjustment and control of the time, extent of duration, of the valve 50 opening relative to the operating cycle of the engine.

Referring now to FIG. 1, the flexible coupling linkage 14 can include a first pivot joint 24*a* defining a restrained point 26*a* associated with the housing 16 radially spaced from an axis of rotation of the rotor 18. When the restrained point 26*a* is anchored with respect to the engine block or head, rotation of the housing 16 about the axis of rotation of the rotor 18 can be limited, while simultaneously allowing angular displacement of the housing 16 about the restrained point 26*a* to permit the housing 16 to match an angle of the rotor 18 while the rotor 18 rotates relative to the housing 16. The flexible coupling linkage 14 can further include a link arm 28 connected at one end to the first pivot joint 24*a* and pivotally anchored at an opposite second end to the engine 20 by a second pivot joint 24*b*. The first pivot joint 24*a* can include a pivot pin 30 attaching the link arm 28 to the housing 16.

The first pivot joint 24*a* can include a ball-and-socket joint 32 formed between the pivot pin 30 and the link arm 28 defining a restrained point 26*a* associated with the housing 16 radially spaced from an axis of rotation of the rotor 18 in order to prevent rotation of the housing 16 about the axis of rotation of the rotor 18. The restrained point 26*a* allows angular displacement of the housing 16 about the restrained point 26*a* permitting the housing 16 to adapt to any misalignment of the rotor 18 relative to the housing 16. The ball-and-socket joint 32 can be defined by a ball 36 formed on the pin 30 and engaged within a corresponding ball-receiving socket 38 formed on the link arm 28 as best seen in FIG. 1.

The second pivot joint 24*b* can include a pivot pin 34 attaching an opposite end of the link arm 28 to the engine 20. The pivot pin 34 can define an axis of rotation 26*b* which is also restrained or relatively stationary with respect to the housing 16 about the axis of rotation of the rotor 18. The pivot pin 34 allows angular displacement of the housing 16 about the pin axis 26*b* to permit the housing 16 to adjust for any buildup of tolerances between the rotor 18 and the housing 16 in cooperation with restrained point 26*a*.

Figure 2:
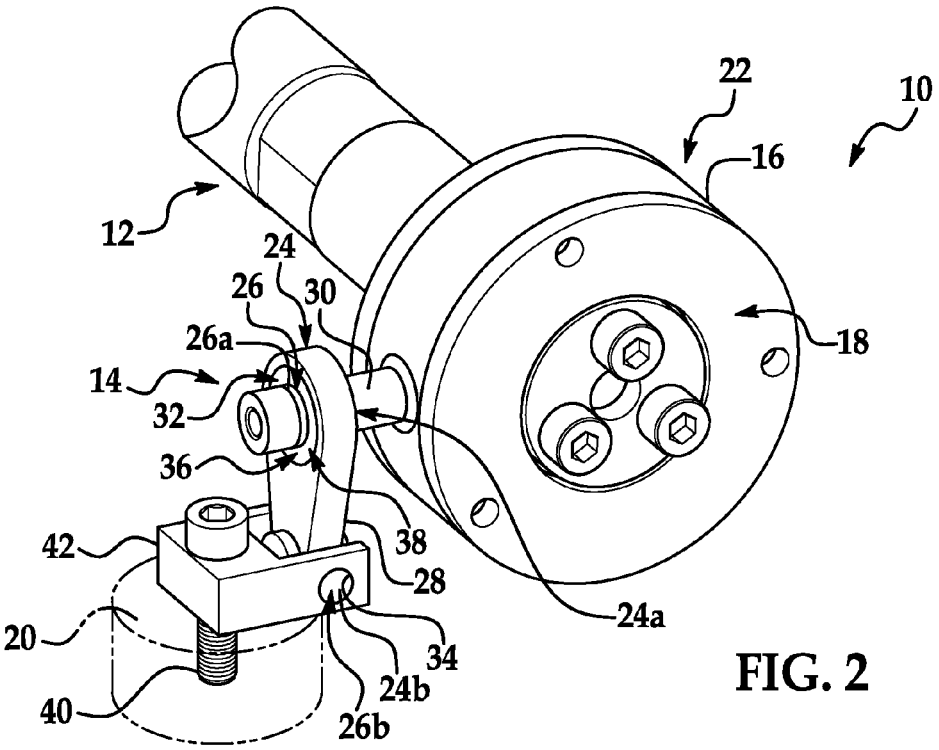
FIG. 2 is a perspective view of a control shaft actuator having a flexible coupling linkage connected to a sidewall of a housing.

Referring now to FIG. 2, the flexible coupling linkage 14 can include a first pivot joint 24*a* including a ball-and-socket joint 32 defining a restrained point 26*a* associated with the housing 16 radially spaced from an axis of rotation of the rotor 18 in order to prevent rotation of the housing 16 about the axis of rotation of the rotor 18. The ball-and-socket joint 32 allows angular displacement of the housing 16 about the restrained point 26*a* permitting the housing 16 to match an angular rotational plane of the rotor 18. The flexible coupling linkage 14 can further include a link arm 28 connected at one end to the first pivot joint 24*a* and pivotally anchored at an opposite second end to the engine 20 by a second pivot joint 24*b*.

The first pivot joint 24*a* can include a pin 30 attaching the link arm 28 to the housing 16. The first pivot joint 24*a* can include a ball-and-socket joint 32 formed between pin 30 attached to the housing 16 and the link arm 28. The ball-and-socket joint 32 anchors the restraining point 26*a* associated with the housing 16 radially spaced from an axis of rotation of the rotor 18 in order to prevent rotation of the housing 16 about the axis of rotation of the rotor 18. The ball-and-socket joint 32 allows angular displacement of the housing 16 about the restraining point 26*a* permitting the housing 16 to adapt to any misalignment of the rotor 18. The ball-and-socket joint 32 can be defined by a ball 36 formed on the pin 30 and engaged within a corresponding ball-receiving socket 38 formed on the link arm 28 as best seen in FIG. 2.

The second pivot joint 24*b* can include a pivot pin 34 attaching an opposite end of the link arm 28 to the engine 20.

The pivot pin 34 can define a restrained or fixed axis 26*b* which is stationary with respect to the housing 16 about the axis of rotation of the rotor 18. The pivot pin 34 allows angular displacement of the housing 16 about the restrained or fixed axis 26*b* to permit the housing 16 to adjust to any build up of tolerances between the rotor 18 and the housing in cooperation with the restrained point 26*a*.

Figure 3:
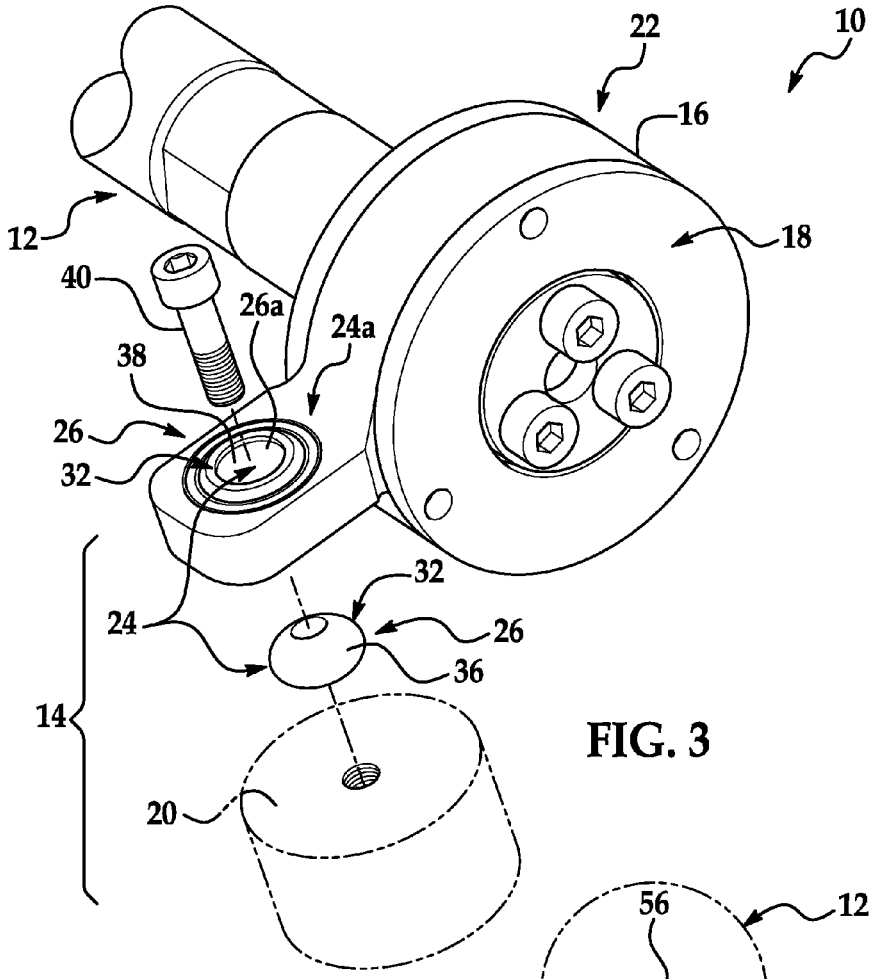
FIG. 3 is a perspective view of a control shaft actuator having a flexible coupling linkage connected to a sidewall of a housing.

Referring now to FIG. 3, the flexible coupling linkage 14 can include a first pivot joint 24*a* including by a ball-and-socket joint 32 defining a restrained point 26*a* associated with the housing 16 radially spaced from an axis of rotation of the rotor 18 in order to restrain or prevent rotation of the housing 16 about the axis of rotation of the rotor 18. The ball-and-socket joint 32 allows angular displacement of the housing 16 about the restrained point 26*a* permitting the housing 16 to match an angular rotational plane of the rotor 18. The flexible coupling linkage 14 can further include a fastener 40 connected at one end to the first pivot joint 24*a* and anchored at an opposite second end to the engine 20.

The first pivot joint 24*a* can include a ball-and-socket joint 32 formed between housing 16 and the link arm 28. The ball-and-socket joint 32 holds the restrained point 26*a* associated with the housing 16 radially spaced from an axis of rotation of the rotor 18 in order to prevent rotation of the housing 16 about the axis of rotation of the rotor 18. The first pivot joint 24*a* allows angular displacement of the housing 16 about the restrained point 26*a* in order to permit the housing 16 to adapt to any misalignment of the rotor 18. The ball-and-socket joint 32 can be defined by a ball 36 formed on the link arm 28 and engaged within a corresponding ball-receiving socket 38 formed on the tab 30 as best seen in FIG. 3. The fastener 40 can pass through an aperture formed in the ball 36.

A method of assembling a variable valve lift and timing assembly 10 for an internal combustion engine 20 of a motor vehicle can include an actuator 22 connected to a control shaft 12 is also disclosed. The actuator 22 can be assembled with a rotor 18 at least partially enclosed by a housing 16. The housing 16 can be assembled to be restrained against rotation with a flexible coupling linkage 14. The flexible coupling linkage 14 can allow free movement of the housing 16 in two other planes relative to the rotor 18 to match an angular rotational plane of the rotor 18 to prevent binding between the housing 16 and the rotor 18 due to misalignment. The flexible coupling linkage 14 can be assembled to be connected between the housing 16 and a structural member of the motor vehicle 20 for restraining the housing 16 against rotation relative to an axis of rotation of the rotor 18. The flexible coupling linkage 14 can permit the housing 16 to move freely in two other planes to adapt to misalignment of the rotor 18 relative to the housing 16.

Rotation of the housing 16 about an axis of rotation of the rotor 18 can be prevented by assembling at least one pivot joint 24*a*, 24*b* defining a corresponding restrained point 26*a*, 26*b* radially spaced from the axis of rotation of the rotor 18. The at least one pivot joint 24*a*, 24*b* can allow angular displacement of the housing 16 about the restrained point 26*a*, 26*b* permitting the housing 16 to adapt to any build up of tolerances between the rotor 18 and the housing 16. A link arm 28 or fastener 40 can be assembled to be pivotally anchored at one end by at least a first pivot joint 24*a*. The link arm 28 can be pivotally anchored at an opposite second end to the engine 20 by a second pivot joint 24*b*.

A first pivot joint 24*a* can be assembled as a ball-and-socket joint 32 defining a restrained point 26*a* associated with the housing 16 radially spaced from the axis of rotation of the rotor 18. The ball-and-socket joint 32 can allow angular displacement of the housing 16 about the restrained point 26*a* permitting the housing 16 to match an angular rotational plane of the rotor 18. The ball-and-socket joint 32 can be assembled from a ball 36 connected to the housing 16 and pivotally anchoring a corresponding ball-receiving socket 38 connected to the engine 20 by a second pivot joint 24*b*. Alternatively, the ball-and-socket joint 32 can be assembled as a ball-receiving socket 38 connected to the housing 16 and pivotally anchoring a corresponding ball 36 connected to the engine 20 with a second pivot joint 24*b*.

A variable valve lift and timing assembly 10 can operate at least one poppet-type valve of an internal combustion engine 20 of a motor vehicle. An actuator 22 can transmit rotational torque to a control shaft 12 of a rocker arm. The actuator 22 can include a housing 16 at least partially enclosing a rotor 18. A flexible coupling linkage 14 can restrain the housing 16 against rotation with respect to an axis of rotation of the rotor 18. The flexible coupling linkage 14 can allow free movement of the housing 16 in two other planes relative to the rotor 18 to match an angular rotational plane of the rotor 18 to prevent binding between the housing 16 and the rotor 18 due to misalignment or build up of tolerances. The flexible coupling linkage 14 can be connected between the housing 16 and a structural member of the internal combustion engine 20. The flexible coupling linkage 14 can be selected from a group of pivot joints including at least one of a pivot pin joint and a ball-and-socket joint, wherein the pivot pin joint and ball-and-socket joint define a restrained point 26*a* associated with the housing 16 radially spaced from the axis of rotation of the rotor 18 preventing rotation of the housing 16 about the axis of rotation of the rotor 18. The pivot joint can allow angular displacement of the housing 16 about the restrained point 26*a* to permit the housing 16 to match the angular rotational plane of the rotor 18 to prevent binding between the housing 16 and the rotor 18 due to misalignment or build up of tolerances in the assembly. The ball- and socket joint 24*a* can be attached to a structural member of the motor vehicle by a fastener 40, either directly as shown in FIG. 3 or through a link arm 28 and pivot pin joint 24*b* as shown in FIGS. 1-2.

In operation, when mounting an actuator 22 between two points, the perpendicularity and tolerance stack up between the parts becomes critical. If the mounting face for the housing 16 are not on the same plane as the rotor 18 then the parts could bind during rotation. Binding can be prevented by using a flexible coupling linkage 14. The flexible coupling linkage 14 can allow the housing 16 to pivot and float around the rotor 18 to prevent binding between the two parts. The flexible coupling linkage 14 can restrain rotation or spinning of the housing 16 with respect to an axis of rotation of the rotor 18, while at the same time the flexible coupling linkage 14 can allow the housing 16 to move freely in the other two planes to match the angle of the rotor 18 during rotation.

The flexible coupling linkage 14 can include a second pivot joint 24*b*, by way of example and not limitation, such as a bolt 40 attached to the head or block of the engine 20 holding one end of an anchor 42 against the engine 20, thereby grounding the anchor 42. Then, a link arm 28 can be placed perpendicular to the anchor 42, and the anchor 42 and link arm 28 can be pinned or bolted together for pivotal movement relative to one another. The link arm 28 can rotate about the bolted or pinned connection. A first pivot joint 24*a*, such as a bolt or a pin 34, can attach the other end of the link arm 28 to the housing 16 or endplates of the phaser 22 through the center of the joint for pivotal movement of the housing 16 and link arm 28 relative to one another. Alternatively, the other end of link arm 28 can include a ball-and-socket joint 32, where a ball 36 can be pressed into a corresponding socket 38 to connect the housing 16 with respect to the flexible coupling linkage 14 for pivotal movement with respect to one another. The flexible coupling linkage 14 restrains the housing 16 from rotating but, because of the pivot joint 24 or ball-and-socket joint 32, the housing 16 is able to align with the rotor 18 so that no binding will occur.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In a variable valve lift and timing assembly (10) for an internal combustion engine (20) of a motor vehicle having an actuator (22) for driving a control shaft (12) of a rocker arm (42) in rotation through at least a predetermined arc (44), the actuator (22) including a housing (16) at least partially enclosing a rotor (18), an improvement comprising:

a flexible coupling linkage (14) restraining the housing (16) against rotation while allowing free movement of the housing (16) in two other planes relative to the rotor (18) to match an angular rotational plane of the rotor (18) to prevent binding between the housing (16) and the rotor (18) due to misalignment.

2. The improvement of claim 1, wherein the flexible coupling linkage (14) is connected between the housing (16) and the internal combustion engine (20) for holding the housing (16) rotationally stationary, while permitting the housing (16) to move freely in two other planes to match an angle of the rotor (18).

3. The improvement of claim 1, wherein the flexible coupling linkage (14) further comprises:

at least one pivot joint (24*a*, 24*b*) defining a restrained point (26*a*, 26*b*) associated with the housing (16) radially spaced from an axis of rotation of the rotor (18) preventing rotation of the housing (16) about the axis of rotation of the rotor (18), while allowing angular displacement of the housing (16) about the restrained point (26*a*, 26*b*) permitting the housing (16) to match an angular rotational plane of the rotor (18).

4. The improvement of claim 1, wherein the flexible coupling linkage (14) further comprises:

a first pivot joint (24*a*) defining a restrained point (26*a*) associated with the housing (16) radially spaced from an axis of rotation of the rotor (18) preventing rotation of the housing (16) about the axis of rotation of the rotor (18), while allowing angular displacement of the housing (16) about the restrained point (26*a*) permitting the housing (16) to match an angular rotational plane of the rotor (18); and a link arm (28) connected at one end to the first pivot joint (24*a*) and pivotally anchored at an opposite second end to the engine (20) by a second pivot joint (24*b*).

5. The improvement of claim 1, wherein the flexible coupling linkage (14) further comprises:

a ball-and-socket joint (32) defining a restrained point (26*a*) associated with the housing (16) radially spaced from an axis of rotation of the rotor (18) preventing rotation of the housing (16) about the axis of rotation of the rotor (18), while allowing angular displacement of the housing (16) about the restrained point (26*a*) permitting the housing (16) to match an angular rotational plane of the rotor (18).

6. The improvement of claim 1, wherein the flexible coupling linkage (14) further comprises:

a ball-and-socket joint (32) defining a restrained point (26*a*) associated with the housing (16) radially spaced from an axis of rotation of the rotor (18) preventing rotation of the housing (16) about the axis of rotation of the rotor (18), while allowing angular displacement of the housing (16) about the restrained point (26*a*) permitting the housing (16) to match an angular rotational plane of the rotor (18), wherein a ball (36) is connected to the housing (16) and a corresponding ball-receiving socket (38) is connected to the engine (20) through a link arm (28) pivotally anchored at an opposite end by a pivot joint (24*b*).

7. The improvement of claim 1, wherein the flexible coupling linkage (14) further comprises:

a ball-and-socket joint (32) defining a restrained point (26*a*) associated with the housing (16) radially spaced from an axis of rotation of the rotor (18) preventing rotation of the housing (16) about the axis of rotation of the rotor (18), while allowing angular displacement of the housing (16) about the restrained point (26*a*) permitting the housing (16) to match an angular rotational plane of the rotor (18), wherein a ball-receiving socket (38) is connected to the housing (16) and a corresponding ball (36) is connected to the engine (20) through a link arm (28) pivotally anchored at an opposite end by a pivot joint (24*b*).

8. In a method of assembling a variable valve lift and timing assembly (10) for an internal combustion engine (20) of a motor vehicle having an actuator (22) for driving a control shaft (12) of a rocker arm (42) in rotation through at least a predetermined arc (44), the actuator (22) having a rotor (18) at least partially enclosed by a housing (16), an improvement comprising:

restraining the housing (16) against rotation with a flexible coupling linkage (14), while allowing free movement of the housing (16) in two other planes relative to the rotor (18) to match an angular rotational plane of the rotor (18) to prevent binding between the housing (16) and the rotor (18) due to misalignment.

9. The improvement of claim 8 further comprising:

connecting the flexible coupling linkage (14) between the housing (16) and the internal combustion engine (20) for restraining the housing (16) against rotation relative to an axis of rotation of the rotor (18), while permitting the housing (16) to move freely in two other planes to match an angular rotational plane of the rotor (18).

10. The improvement of claim 8 further comprising:

preventing rotation of the housing (16) about an axis of rotation of the rotor (18) with at least one pivot joint (24*a*, 24*b*) defining a restrained point (26*a*, 26*b*) radially spaced from the axis of rotation of the rotor (18), while allowing angular displacement of the housing (16) about the restrained point (26*a*, 26*b*) permitting the housing (16) to match an angular rotational plane of the rotor (18).

11. The improvement of claim 8 further comprising:

preventing rotation of the housing (16) about an axis of rotation of the rotor (18) with a first pivot joint (24*a*) defining a restrained point (26*a*) associated with the housing (16) radially spaced from the axis of rotation of the rotor (18), while allowing angular displacement of the housing (16) about the restrained point (26*a*) permitting the housing (16) to match an angular rotational plane of the rotor (18); and pivotally anchoring a link arm (28) connected at one end to the first pivot joint (24*a*) and pivotally anchoring the link arm (28) at an opposite second end to the engine (20) by a second pivot joint (24*b*).

12. The improvement of claim 8 further comprising:

preventing rotation of the housing (16) about an axis of rotation of the rotor (18) with a ball-and-socket joint (32) defining a restrained point (26*a*) associated with the housing (16) radially spaced from the axis of rotation of the rotor (18), while allowing angular displacement of the housing (16) about the restrained point (26*a*) permitting the housing (16) to match an angular rotational plane of the rotor (18).

13. The improvement of claim 8 further comprising:

preventing rotation of the housing (16) about an axis of rotation of the rotor (18) with a ball-and-socket joint (32) defining a restrained point (26*a*) associated with the housing (16) radially spaced from the axis of rotation of the rotor (18), while allowing angular displacement of the housing (16) about the restrained point (26*a*) permitting the housing (16) to match an angular rotational plane of the rotor (18); and connecting a ball (36) to the housing (16) and pivotally anchoring a corresponding ball-receiving socket (38) to the engine (20) with a pivot joint (24*b*).

14. The improvement of claim 8 further comprising:

preventing rotation of the housing (16) about an axis of rotation of the rotor (18) with a ball-and-socket joint (32) defining a restrained point (26*a*) associated with the housing (16) radially spaced from the axis of rotation of the rotor (18), while allowing angular displacement of the housing (16) about the restrained point (26*a*) permitting the housing (16) to match an angular rotational plane of the rotor (18); and connecting a ball-receiving socket (38) to the housing (16) and pivotally anchoring a corresponding ball (36) to the engine (20) with a pivot joint (24*b*).

15. In a variable valve lift and timing assembly (10) for changing operating characteristics of at least one poppet-type valve (50) of an internal combustion engine (20) of a motor vehicle, an actuator (22) for driving a control shaft (12) of a rocker arm (42) in rotation through at least a predetermined arc (44), the actuator (22) including a housing (16) at least partially enclosing a rotor (18), an improvement of comprising:

a flexible coupling linkage (14) restraining the housing (16) against rotation with respect to an axis of rotation of the rotor (18), while allowing free movement of the housing (16) in two other planes relative to the rotor (18) to match an angular rotational plane of the rotor (18) to prevent binding between the housing (16) and the rotor (18) due to misalignment, wherein the flexible coupling linkage (14) is connected between the housing (16) and the internal combustion engine (20), the flexible coupling linkage (14) selected from a group of pivot joints including at least one of a pivot pin joint and a ball-and-socket joint, wherein the pivot pin joint and ball-and-socket joint define a restrained point (26*a*) associated with the housing (16) radially spaced from the axis of rotation of the rotor (18) preventing rotation of the housing (16) about the axis of rotation of the rotor (18), while allowing angular displacement of the housing (16) about the restrained point (26*a*) permitting the housing (16) to match the angular rotational plane of the rotor (18).

* * * * *